US008258389B2

(12) United States Patent
Suzuki

(10) Patent No.: US 8,258,389 B2
(45) Date of Patent: Sep. 4, 2012

(54) KEYBOARD DEVICE

(75) Inventor: Hirotsugu Suzuki, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 533 days.

(21) Appl. No.: 12/562,847

(22) Filed: Sep. 18, 2009

(65) Prior Publication Data

US 2010/0074668 A1 Mar. 25, 2010

(30) Foreign Application Priority Data

Sep. 25, 2008 (JP) ..... 2008-245798

(51) Int. Cl.
*G10C 1/00* (2006.01)

(52) U.S. Cl. ..... 84/441; 84/423 R; 84/432; 84/434; 84/435

(58) Field of Classification Search ..... 84/423 R, 84/432–435, 441
See application file for complete search history.

(56) References Cited

U.S. PATENT DOCUMENTS

| | | | | |
|---|---|---|---|---|
| 3,135,153 | A * | 6/1964 | Lo Duca | 84/433 |
| 3,251,923 | A * | 5/1966 | Lund | 84/423 R |
| 3,330,176 | A * | 7/1967 | Schwartz et al. | 84/433 |
| 3,722,351 | A * | 3/1973 | Allen et al. | 84/423 R |
| 4,091,707 | A * | 5/1978 | Martin et al. | 84/423 R |
| 4,418,605 | A * | 12/1983 | Tollefsen et al. | 84/434 |
| 5,696,340 | A * | 12/1997 | Ragni | 84/423 R |
| 6,369,309 | B1 * | 4/2002 | Nishida | 84/423 R |
| 7,141,729 | B2 * | 11/2006 | Uno et al. | 84/236 |
| 7,425,672 | B2 * | 9/2008 | Haba et al. | 84/423 R |
| 7,439,436 | B2 * | 10/2008 | Sakurai | 84/423 R |
| 7,576,273 | B2 * | 8/2009 | Uno et al. | 84/236 |
| 7,750,222 | B2 * | 7/2010 | Osuga | 84/423 R |
| 7,767,892 | B2 * | 8/2010 | Osuga | 84/423 R |
| 7,923,619 | B2 * | 4/2011 | Suzuki | 84/423 R |
| 8,110,732 | B2 * | 2/2012 | Shimoda | 84/423 R |
| 8,119,895 | B2 * | 2/2012 | Kitajima | 84/423 R |
| 8,158,876 | B2 * | 4/2012 | Kitajima et al. | 84/743 |
| 2007/0017343 | A1 * | 1/2007 | Nishida | 84/423 R |
| 2010/0074668 | A1 * | 3/2010 | Suzuki | 400/495 |

FOREIGN PATENT DOCUMENTS

| | | |
|---|---|---|
| JP | 9244623 | 9/1997 |
| JP | 11175054 | 7/1999 |

* cited by examiner

*Primary Examiner* — David Warren
*Assistant Examiner* — Robert W Horn
(74) *Attorney, Agent, or Firm* — Morrison & Foerster LLP

(57) ABSTRACT

In a keyboard device, a frame function part is provided integrally in a frame to engage with a component of the keyboard device excluding the frame. Integrated continuous parts are formed at the frame and extend continuously over a key zone including a plurality of keys. The integrated continuous part receives external force directly or via the frame function part or allows a component constructed separately from the frame to mount on the integrated continuous part. A connection rib is formed in the frame such that the connection rib extends in a direction intersecting a direction along which the keys are arranged side-by-side. The integrated continuous parts are formed at positions deviated with respect to each other, when viewed from a side of the frame. The integrated continuous parts are connected to each other only by the connection rib.

8 Claims, 6 Drawing Sheets

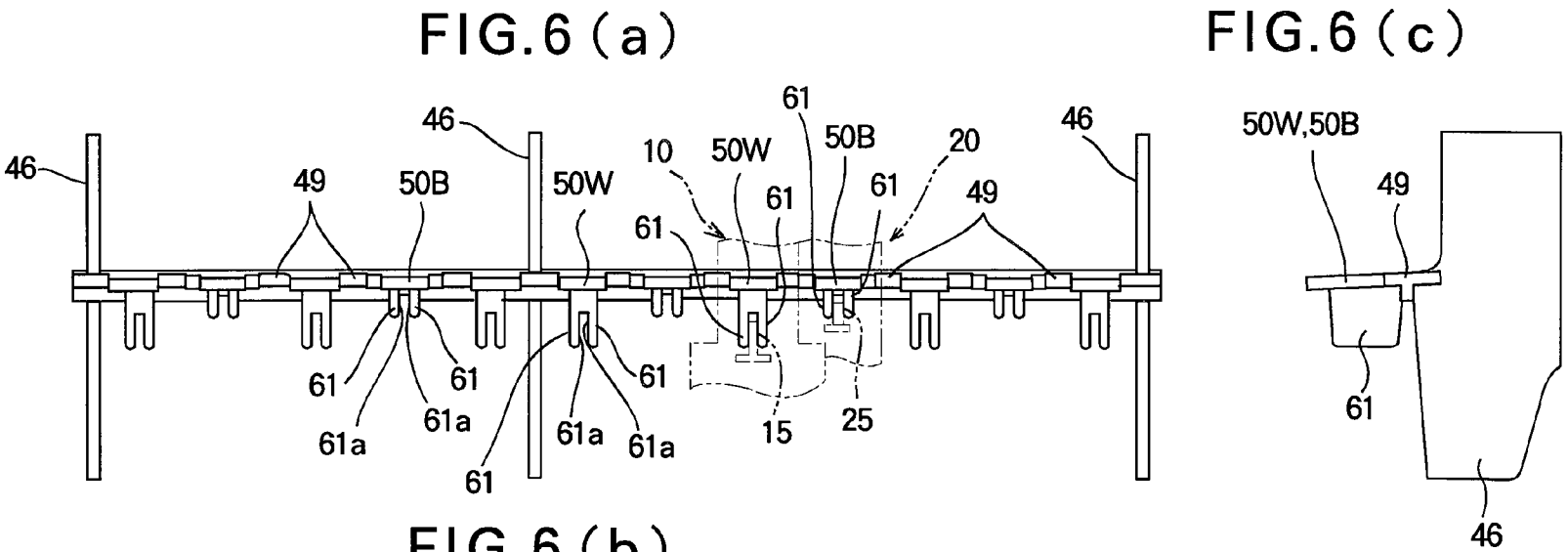
FIG.6 (c)
FIG.6 (a)
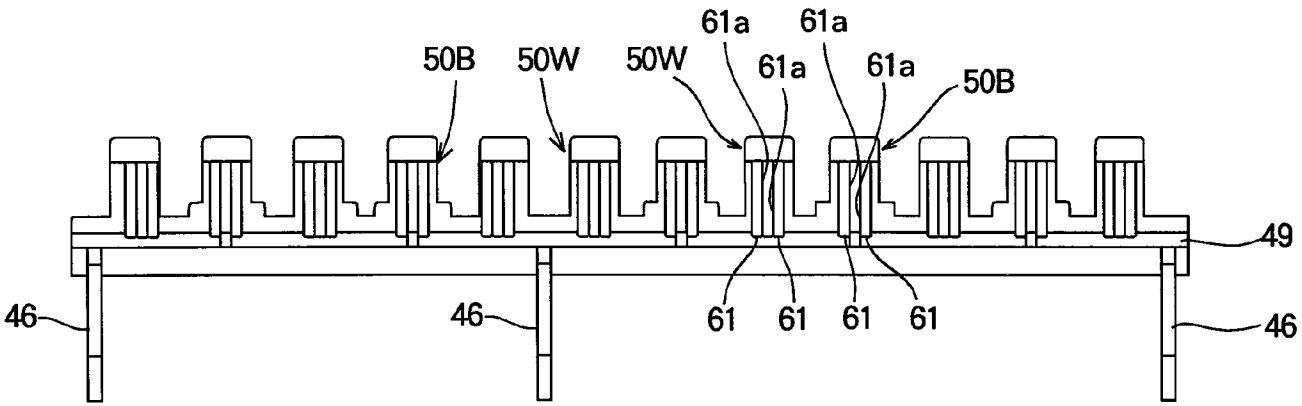
FIG.6 (b)

KEYBOARD DEVICE

BACKGROUND OF THE INVENTION

1. Technical Field of the Invention

The present invention relates to keyboard device having a frame formed of resin in one united body to support a plurality of keys such that the keys can pivot.

2. Description of the Related Art

Conventional keyboard devices have been known in which a frame to support a plurality of keys for allowing the keys to pivot is supported on an instrument main body. In particular, keyboard devices have been known in which the frame is formed of resin in one united body (Patent documents 1 and 2 below).

In a keyboard device, a part functioning as a frame, i.e., a "frame function part" engaging, in contact, with a component excluding the frame during the use of the keyboard device, is provided at the frame in one united body or as a separate body. In Patent documents 1 and 2 below, for example, there are various frame function parts including a stopper to restrict a rotation start position and a rotation end position of a key and a hammer, a key operating guide, a board mount part, and a deck contact part.

Since external force is applied to the portions of the frame where these frame function parts are provided, it is preferable to design the frame such that the frame exhibits high stiffness. For a frame made of resin, such high stiffness is secured generally by providing a sufficient amount of resin to the portions of the frame.

[Patent document 1] Japanese Patent No. 3819136

[Patent document 2] Japanese Patent Application Publication No. H9-244623

When the amount of resin used is increased, however, the cost is increased, and, in addition, the weight is also increased. In Patent documents 1 and 2 above, a plate-shaped member of the frame is large, and the stiffness is also high. However, the amount of resin used is large, and therefore, improvement thereof is necessary. Also, it is necessary to consider the arrangement positions of the frame function parts in addition to the reduction of the amount of resin while appropriately securing the stiffness.

SUMMARY OF THE INVENTION

Therefore, the present invention has been made in view of the above problems of the related art, and it is an object of the present invention to provide a keyboard device that is capable of securing high bending stiffness in the upward-and-downward direction and the frontward-and-rearward direction even in a frame structure having a small plate-shaped part and, at the same time, reducing the amount of resin used.

In order to accomplish the above object, a keyboard device according to a first aspect of the present invention comprises: a plurality of keys arranged in parallel to each other; a frame formed of resin in one united body, the frame being supported at an instrument main body and supporting the respective keys such that the respective keys are pivoted by key-pressing operation and key-releasing operation; a frame function part provided at the frame in one united body with the frame or as a separate body from the frame, the frame function part being configured to engage, in contact, with a component of the keyboard device excluding the frame during the use of the keyboard device; at least two integrated continuous parts comprising a part formed at the frame in one united body with the frame, the integrated continuous part extending continuously over a key zone including a plurality of keys in a first direction along which the keys are arranged side-by-side, the integrated continuous part receiving external force directly or via the frame function part and/or allowing a component constructed separately from the frame to mount on the integrated continuous part; and a connection rib formed at the frame in one united body with the frame such that the connection rib extends in a direction intersecting the first direction along which the keys are arranged side-by-side, each connection rib being provided per a plurality of keys, wherein the at least two integrated continuous parts are formed at positions deviated with respect to each other, when viewed from a side of the frame, in both a second direction along which the keys are pivoted by key-pressing operation and key-releasing operation and a third direction along which each key extends from front to rear of the keyboard device, the at least two integrated continuous parts being connected to each other only by the connection rib.

Preferably in a second aspect of the invention, the connection rib is formed in the shape of a plate extending in a direction perpendicular to the first direction along which the keys are arranged side-by-side.

Preferably in a third aspect of the invention, the integrated continuous parts comprise at least three integrated continuous parts, and the at least three integrated continuous parts are not aligned in a straight line when viewed from the side of the frame.

Preferably in a fourth aspect of the invention, the keyboard device further comprises: a key guide part provided for each of the keys to guide pivoting movement of the corresponding key; and an initial stopper part contacting each of the keys or a rotary member linked to each of the keys to rotate with each key, such that the initial stopper restricts an initial position of each key at the key-pressing operation in a going stroke of the key, wherein the frame function part comprises the key guide part and the initial stopper part, and the integrated continuous parts comprise a key guide arrangement part where the key guide part is provided and an initial stopper arrangement part where the initial stopper part is provided, the key guide arrangement part and the initial stopper arrangement part being separated from each other above a part of the frame contacting the instrument main body and being connected to the part of the frame only by the connection rib.

Preferably in a fifth aspect of the invention, the keyboard device further comprises a plurality of hammers arranged in parallel to each other such that the hammers correspond to the respective keys, the hammers providing inertia with respect to the pivoting movements of the corresponding keys, wherein the frame function part comprises a plurality of hammer support parts formed at the frame in one united body and arranged in the first direction along which the keys are arranged side-by-side, the hammer support parts supporting the respective hammers such that the hammers are operatively connected to the corresponding keys below the corresponding keys to rotate about the respective hammer support parts, and the integrated continuous parts include a hammer shaft arrangement part where the hammer support parts are provided.

Preferably in a sixth aspect of the invention, the frame function part comprises a key guide part provided for each of the keys to guide the pivoting movement of the corresponding key, and the integrated continuous include a key guide arrangement part where the key guide parts are provided.

Preferably in a seventh aspect of the invention, each of the hammers is configured such that a rear part of each of the hammers is rotated upward during a going stroke of the corresponding key, the frame function part comprises a hammer stopper contacting a front portion of each of the hammers during the going stroke of the key to restrict a rotation start position of each of the hammers, and the integrated continuous parts include a hammer stopper arrangement part where the hammer stoppers are provided.

Preferably in an eighth aspect of the invention, the frame function part comprises a main body contact part contacting the instrument main body to support the frame at the instrument main body, the main body contact part being configured to belong to the integrated continuous parts and also to function as the hammer support parts.

According to the first aspect of the present invention, it is possible to secure high bending stiffness in the second direction along which the keys are pivoted by key-pressing operation and key-releasing operation (upward-and-downward direction) and the third direction along which each key extends from front to rear of the keyboard device (frontward-and-rearward direction) even in a frame structure having a small plate-shaped part and, at the same time, to reduce the amount of resin used.

According to the second aspect of the present invention, it is possible to more effectively secure stiffness by the connection ribs manufactured using a small amount of resin.

According to the third aspect of the present invention, it is possible to increase bending stiffness in all directions perpendicular to the first direction along which the keys are arranged side-by-side (side-by-side arrangement direction of keys).

According to the fourth aspect of the present invention, it is possible to increase a degree of freedom in arrangement of the key guide part and the initial stopper part, to which no large load is applied, by separating the key guide arrangement part and the initial stopper arrangement part from regions to which a large load is applied from the instrument main body.

According to the fifth aspect of the present invention, it is possible to secure high bending stiffness of the keyboard device including the hammers in the upward-and-downward direction and the frontward-and-rearward direction and, at the same time, to reduce the amount of resin used.

According to the eighth aspect of the present invention, it is possible to efficiently arrange the integrated continuous parts by the provision of the main body contact part with two functions and to contribute to the reduction of resin.

BRIEF DESCRIPTION OF THE DRAWINGS

FIGS. 6(*a*) to 6(*c*) are a partial plan view (FIG. 6(*a*)), a front view (FIG. 6(*b*)), and a right side view (FIG. 6(*c*)) illustrating key guide connection parts and key guide parts of a second example of the keyboard device according to the third embodiment of the present invention.

DETAILED DESCRIPTION OF THE INVENTION

Hereinafter, embodiments of the present invention will be described in detail with reference to the accompanying drawings.

First Embodiment

Figure 1:
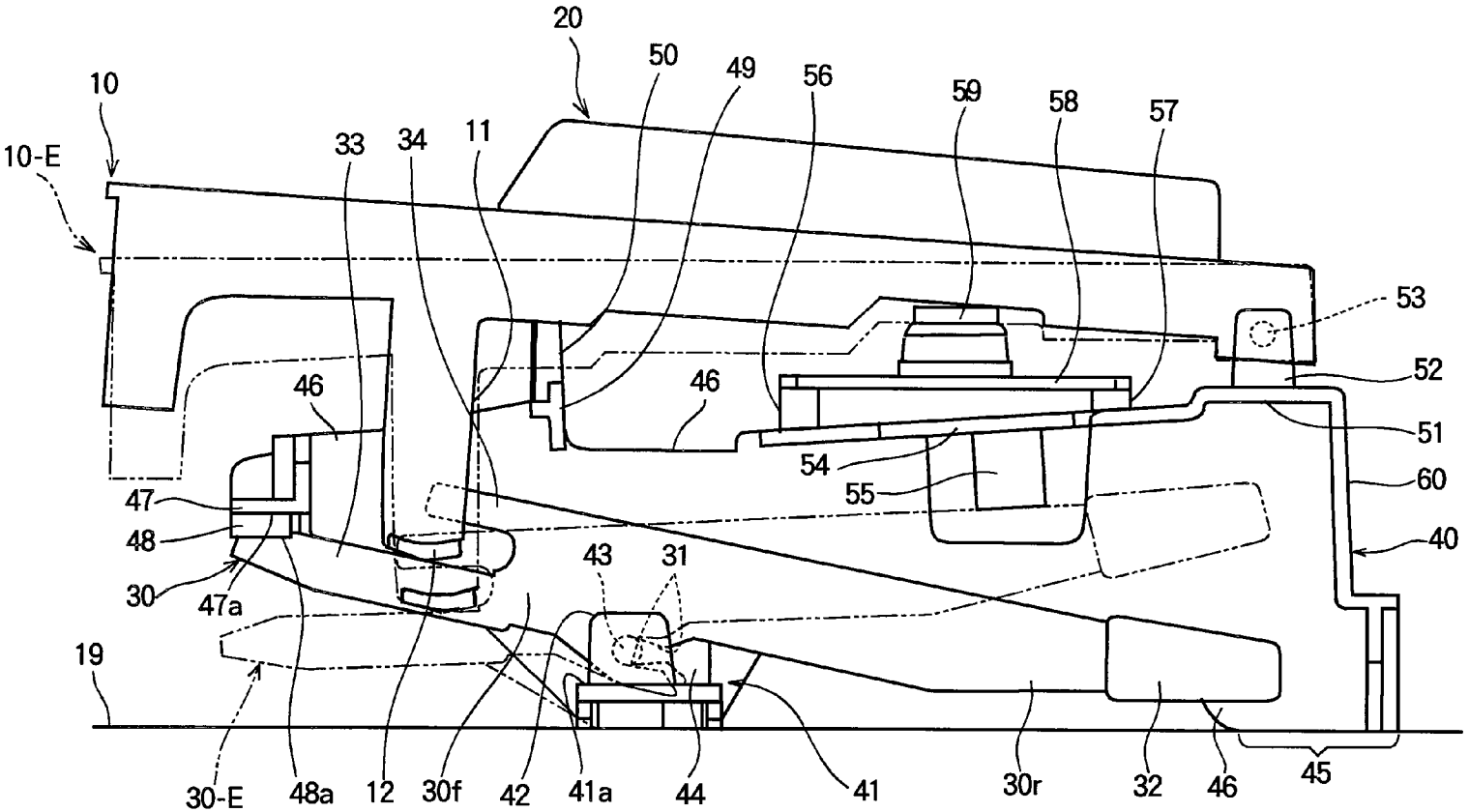
FIG. 1 is a side view illustrating the interior structure of a keyboard device according to a first embodiment of the present invention.

FIG. 1 is a side view illustrating the interior structure of a keyboard device according to a first embodiment of the present invention. The keyboard device is applicable to, for example, an electronic keyboard instrument. The keyboard device is constructed such that a plurality of white keys 10, a plurality of black keys 20, and a plurality of hammers 30 are arranged in a frame 40 formed of a resin in one united body. It is assumed that the side where a performer is positioned with respect to the keyboard device is the front side of the keyboard device. Therefore, the left and right of the drawing correspond to the front and rear of the keyboard devices, respectively. Also, it is assumed that the left-and-right direction is based on the direction seen from the performer.

The white keys 10 and the black keys 20 are arranged in parallel along the left-and-right direction (also referred to as the "side-by-side arrangement direction of keys"). The hammers 30 are arranged in parallel along the side-by-side arrangement direction of keys. The hammers 30 are arranged such that the hammers 30 correspond to the respective keys. Specifically, the hammers 30 are arranged below the respective keys 20 to provide inertia with respect to the pivoting movements of the respective keys.

Figure 2:
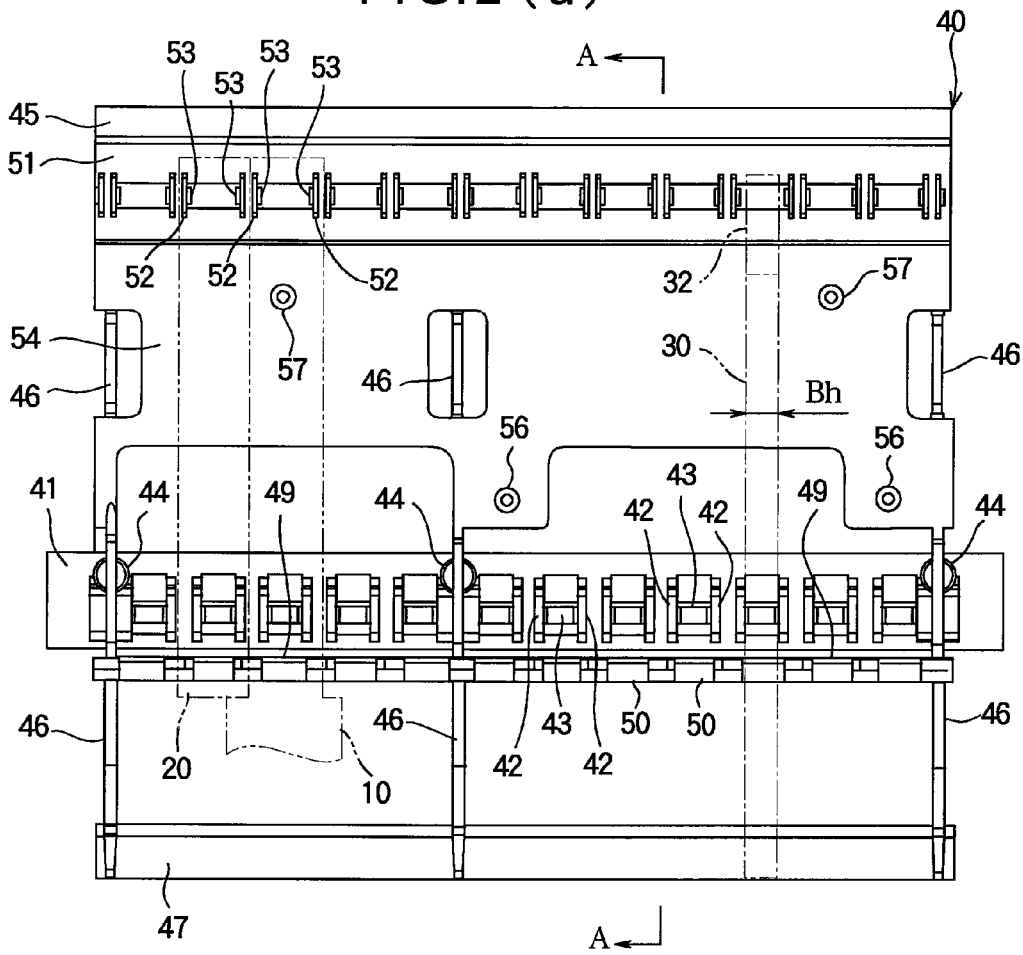
FIGS. 2(*a*) and 2(*b*) are a plan view and a front view illustrating a frame, respectively.
Figure 2:
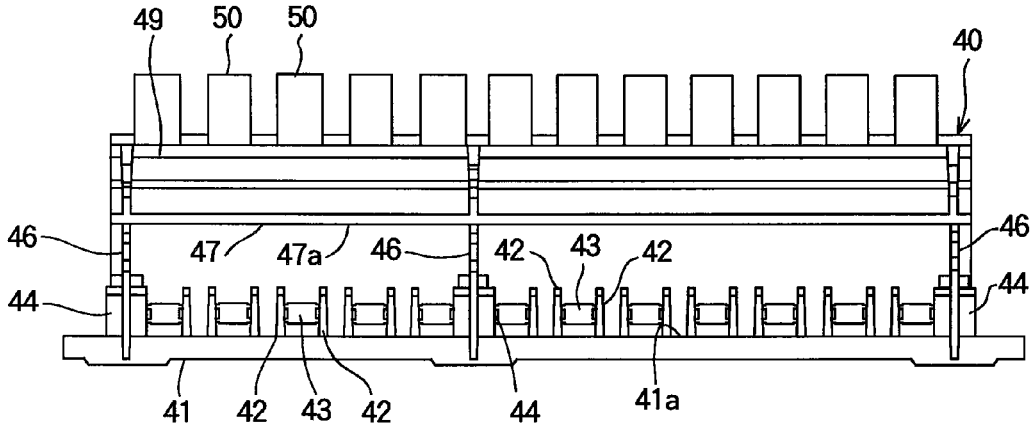
Figure 3:
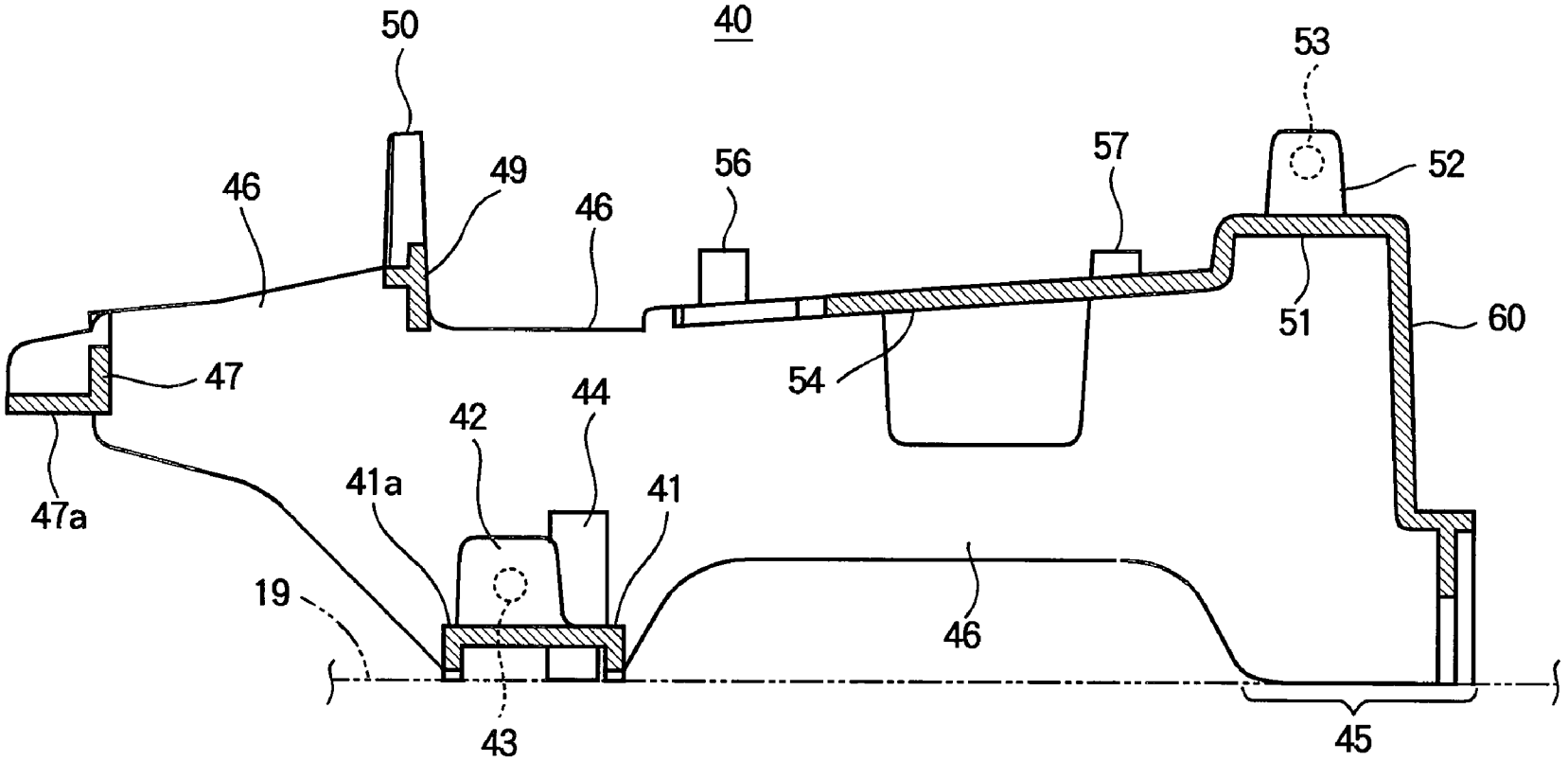
FIG. 3 is a sectional view taken along line A-A of FIG. 2(*a*).

FIGS. 2(*a*) and 2(*b*) are a plan view and a front view of the frame 40. FIG. 3 is a sectional view taken along line A-A of FIG. 2(*a*). Although only one octave zone of the frame 40 is shown in FIGS. 2(*a*) and 2(*b*), the frame 40 may be shown to have a length corresponding to a certain key zone having a plurality of keys or the entirety of the keys.

The white keys 10 and the black keys 20 are supported at corresponding key support parts 53 of the frame 40 in such a manner that the front ends of the white keys 10 and the black keys 20 can vertically pivot about the key support parts 53. The key support parts 53 may support the keys 10 and 20 in a pivoting manner. Alternatively, the key support parts 53 may be configured in a hinge type structure. That is, the structure of the key support parts 53 is not restricted. The hammers 30 are supported at corresponding hammer rotation shafts 43 of the frame 40 in such a manner that the hammers 30 can vertically rotate (the front ends and rear ends of the hammers 30 can vertically pivot) about the hammer rotation shafts 43. A lower perpendicular piece 11 protrudes downward from the front part of each of the white keys 10. The lower end of the lower perpendicular piece 11 constitutes a hammer drive part 12 including a shock-absorbing member. The same structure is applied to each of the black keys 20.

As shown in FIG. 1, each of the hammers 30 is constructed in a rod-shaped structure including an engagement depression 31 to engage with the corresponding hammer rotation shaft 43, a front extension part 30*f* located in front of the engagement depression 31, and a rear extension part 30*r* located in the rear of the engagement depression 31. The engagement depression 31 is open at the rear thereof. At the rear end of the rear extension part 30*r* is provided a mass part 32 which occupies a major portion of the entire mass of each of the hammers 30. At the front extension part 30*f* is formed a claw-shaped engagement part including a long lower engagement part 33 and a short upper engagement part 34. The lower engagement part 33 and the upper engagement part 34 are in continuous engagement with the hammer drive part 12 of the corresponding one of the white keys 10 and the black keys 20. Each of the hammers 30 is operatively connected to the corresponding one of the keys such that each of the hammers 30 can rotate in both the going direction and the returning direction.

In FIG. 1, the white keys 10, the black keys 20, and the hammers 30 are shown in an initial state or rest state in which the white keys 10, the black keys 20, and the hammers 30 are not pressed. At the same time, the white keys 10 and the hammers 30 are shown as white keys 1-E and hammers 30-E in a key-pressing end state.

The frame 40 is manufactured in one united body by injection molding. The frame 40 is fixed to the top of a deck 19 (See FIGS. 1 and 3). The deck 19 may be part of the instrument main body, or may be a bottom plate of a lower case while the deck 19 is not particularly named. As will be described hereinafter in detail, the frame 40 is constructed in a structure in which portions of the frame 40 extending in one united body over the total length in the side-by-side arrangement direction of keys are connected to one another by a plurality of vertical ribs 46 spaced apart from one another in the side-by-side arrangement direction of keys.

First, as shown in FIG. 3, a stopper mount part 47 is provided at the frontmost part of the frame 40. At the rear of the stopper mount part 47 is provided a key guide connection part 49, which is located above the stopper mount part 47. At the rear of the key guide connection part 49 is provided a front side support part 41, which is located at the lowermost part of the frame 40. A rear side support part 45 is provided at the lowermost part of the rear of the frame 40. The lower ends of the front side support part 41 and the rear side support part 45 are in direct contact with the deck 19.

A rear side wall part 60 vertically rises upward from the rear side support part 45 such that the rear side wall part 60 forms a step toward the front side. A key support part connection part 51 extends frontward from the upper part of the rear side wall part 60 in one united body. A step is formed toward the lower side from the front part of the key support part connection part 51. A plate-shaped part 54 extends frontward while the plate-shaped part 54 is inclined gradually downward. The plate-shaped part 54 is approximately the middle of the frame 40 in the frontward-and-rearward direction that is a depth direction of the keyboard device. The plate-shaped part 54 extends more rearward than the front side support part 41.

In particular, the stopper mount part 47, the key guide connection part 49, the front side support part 41, the key support part connection part 51, and the plate-shaped part 54 correspond to the above-described "portions of the frame 40 extending in one united body over the total length in the side-by-side arrangement direction of keys" (See FIGS. 2(*a*) and 2(*b*)). These portions, the rear side support part 45, and the rear side wall part 60 are connected to one another in one united body by the vertical ribs 46 (See FIG. 3). The vertical ribs 46 are provided such that one vertical rib 46 corresponds to several keys. For example, as shown in FIGS. 2(*a*) and 2(*b*), two or three vertical ribs 46 may be provided for each octave, although the number of the vertical ribs 46 is not particularly restricted.

As shown in FIG. 1, an initial stopper 48 is mounted to the bottom 47*a* of the stopper mount part 47 such that the initial stopper 48 contacts the lower engagement part 33 of the corresponding hammer 30 to restrict a rotation start position of the hammer 30 during the going stroke of the pressed key. The stopper mount part 47 is an initial stopper arrangement part where the initial stoppers 48 are provided. In a state in which a key is not pressed, the rear extension part 30*r* of the hammer 30 is lowered due to the weight of the mass part 32, with the result that the lower engagement part 33 is in constant contact with the bottom 48*a* of the initial stopper 48. On the other hand, the lower engagement part 33 and the hammer drive part 12 of the corresponding one of the white keys 10 and the black keys 20 are constantly engaged with each other. As a result, the rotation start position of the hammer 30 is restricted. Consequently, the home position in which the key is not pressed, i.e., the initial position of each of the white keys 10 and the black keys 20, is also restricted, and therefore, the respective levels of the key faces of the white keys 10 and the black keys 20 are uniformly aligned.

An end stopper 55 is mounted to the bottom of the plate-shaped part 54 such that the end stopper 55 contacts the mass part 32 of the rear extension part 30*r* of the corresponding hammer 30 to restrict a rotation end position of the hammer 30. When a key-pressing operation is performed, the hammer drive part 12 of each of the keys 10 and 20 drives the lower engagement part 33 of the hammer 30, with the result that the hammer 30 rotates in the counterclockwise direction of FIG. 1. When the rear extension part 30*r* comes into contact with the end stopper 55, the key-pressing end position or the rotation end position of each of the keys 10 and 20 and the hammer 30 is restricted during the going stroke of the pressed key. When a key-releasing operation is performed in a key-pressing end state, the returning stroke of the pressed key is performed. As a result, the hammer 30 rotates in the clockwise direction due to the weight of the mass part 32 to return to its initial position.

Both the initial stopper 48 and the end stopper 55 are formed of soft material, such as felt, having a shock-absorbing function, and are provided in one united body over the total length in the side-by-side arrangement direction of keys. Alternatively, the initial stopper 48 and the end stopper 55 may be provided for each hammer 30. As another alternative, the initial stopper 48 and the end stopper 55 may be formed of a soft material such as elastomer, and may be formed at the frame 40 in one united body by one-piece molding through two-color molding. A plurality of board mount parts 56 and 57 are formed at the top of the plate-shaped part 54 in one united body (Also see FIGS. 2(*a*) and 2(*b*)). A board 58 is threadedly fixed to the board mount parts 56 and 57.

A key switch 59 corresponding to each of the keys is disposed on the board 58. When one of the keys 10 and 20 is pressed, the key switch 59 senses the key-pressing operation of the corresponding one of the keys 10 and 20. The instrument main body includes a musical sound generation device (not shown), which generates a musical sound based on the sensing result of the key switch 59.

As shown in FIGS. 1 to 3, a key guide part 50 protrudes upward from the key guide connection part 49 in one united body. The key guide connection part 49 is a key guide arrangement part where the key guide parts 50 are provided. The key guide part 50 is provided for each key to guide the pivoting movement of the corresponding key. The key guide part 50 may be formed separately from the frame 40 and then fixed to the frame 40. A pair of protruding pieces 42 protrude from the top 41*a* of the front side support part 41 such that the protruding pieces 42 correspond to each hammer 30. The hammer rotation shaft 43 is formed between a pair of protruding pieces 42.

A plurality of bosses 44 are also formed at the front side support part 41 in one united body. Furthermore, although not shown, a plurality of bosses are also formed at the rear side support part 45 in one united body. The frame 40 is fixed to the instrument main body by threadedly fixing the deck from below through threaded holes (not shown) provided in these bosses 44. Positions where the bosses 44 are formed in the side-by-side arrangement direction of keys correspond to the positions where the vertical ribs 46 are formed. Consequently, various kinds of force applied to the frame 40 are easily transmitted to the deck 19 in a direct manner through the vertical ribs 46 and the bosses 44. The front side support part 41 is a main body contact part contacting the instrument main body to support the frame at the instrument main body, the main body contact part being configured to belong to the integrated continuous parts and also to function as the hammer support parts.

A pair of protruding pieces 52 protrude from the top of the key support part connection part 51 in one united body such that the protruding pieces 52 correspond to each key. The above-described key support parts 53 are formed at the surface where a pair of protruding pieces 52 are opposite to each other.

The initial stopper 49, the key guide part 50, the hammer rotation shaft 43, the key support part 53, the key switch 59, and the end stopper 55 engage, in contact, with the components of the keyboard device excluding the frame 40 during the use of the keyboard device. The initial stopper 49, the key guide part 50, the hammer rotation shaft 43, the key support part 53, the key switch 59, and the end stopper 55 are components causing the frame 40 to function as a key frame and a hammer frame to appropriately support the keys 10 and 20 and the hammers 30. These components are referred to as "frame function parts." The front side support part 41 and the rear side support part 45 having a function to make them to be fixed to the deck 19 in a direct contact manner. Consequently, the front side support part 41 and the rear side support part 45 are also included in "frame function parts."

On the other hand, the key guide connection part 49, the front side support part 41, the key support part connection part 51, and the plate-shaped part 54 function to interconnect a plurality of identical components (key guide part 50, hammer rotation shaft 43, key support part 53, key switch 59) in the side-by-side arrangement direction of keys. The stopper mount part 47 is the portion where the initial stopper 48 is mounted. Also, the stopper mount part 47 is the portion extending continuously in one united body in the side-by-side arrangement direction of keys. The plate-shaped part 54 is the portion where the end stopper 55 is mounted, and, at the same time, the board 58 is mounted via the board mount parts 56 and 57. Also, the plate-shaped part 54 is the portion extending continuously in one united body in the side-by-side arrangement direction of keys. The front side support part 41 and the rear side support part 45 are in contact with the deck 19. The front side support part 41 and the rear side support part 45 are the portions receiving reaction force from the deck 19 when each of the keys is pressed. Also, the front side support part 41 and the rear side support part 45 are the portions extending continuously in one united body in the side-by-side arrangement direction of keys that is a widthwise direction of the keyboard device. The key guide connection part 49, the front side support part 41, the key support part connection part 51, and the plate-shaped part 54, the stopper mount part 47, and the rear side support part 45 are referred to as "integrated continuous parts."

The "integrated continuous parts" are defined as "portions formed at the frame 40 in one united body, extending continuously in one united body over a key zone having a plurality of keys in the side-by-side arrangement direction of keys, receiving external force directly or via the frame function parts, and/or where components constructed separately from the frame 40 are mounted."

As described above, the frame 40 is constructed in a curb-shaped structure in which, when viewed from the side of the frame 40, the above-described integrated continuous parts are formed at positions deviated with respect to one another in both the upward-and-downward direction and the frontward-and-rearward direction, and connected to one another only by the vertical ribs 46. Consequently, high bending stiffness of the frame in the upward-and-downward direction and the frontward-and-rearward direction is achieved. Furthermore, one vertical rib 46 is provided per several keys, and therefore, an amount of resin used is reduced. Also, the vertical ribs 46 extend in the shape of a plate in the direction perpendicular to the side-by-side arrangement direction of keys, and therefore, it is possible to secure the stiffness of the vertical ribs 46 with high efficiency while the vertical ribs 46 are formed of a small amount of resin.

In particular, when paying attention to three components i.e., the key guide connection part 49, the front side support part 41, and the stopper mount part 47, located at the front half of the frame 40, of the integrated continuous parts, as shown in FIG. 3, these three components are not alinged in a straight line when viewed from the side of the frame 40. Also, when paying attention to three components, i.e., the key support part connection part 51, the plate-shaped part 54, and the rear side support part 45, located at the rear half of the frame 40, these three components are not arranged in a straight line when viewed from the side of the frame 40. That is, the number of the integrated continuous parts which are not arranged in a straight line is three or more. Consequently, the bending stiffness of the frame 40 in all directions perpendicular to the side-by-side arrangement direction of keys is increased. Furthermore, high stiffness is individually secured at the front half and the rear half of the frame 40.

Also, the key guide connection part 49 and the stopper mount part 47 are separated from each other above the front side support part 41 and the rear side support part 45, which are in direct contact with the deck 19, and, at the same time, are connected to the front side support part 41 and the rear side support part 45 only by the corresponding vertical rib 46. Since a load applied to the key guide connection part 49 and the stopper mount part 47 is naturally small, the key guide connection part 49 and the stopper mount part 47 may be disposed such that the key guide connection part 49 and the stopper mount part 47 are separated from the regions contacting the deck 19, and therefore, the regions immediately below the key guide connection part 49 and the stopper mount part 47 are not directly supported by the deck 19. Also, it is not necessary to use a large amount of resin. On the other hand, the front side support part 41 and the rear side support part 45 receive a large load from the deck 19, and therefore, it is necessary to increase strength of the front side support part 41 and the rear side support part 45 by using a large amount of resin. Consequently, it is possible to increase a degree of freedom in arrangement of the key guide connection part 49 and the stopper mount part 47 by separating the key guide connection part 49 and the stopper mount part 47 from each other above the front side support part 41 and the rear side support part 45.

When the hammer 30 is assembled to the frame 40, the hammer 30 is inserted into the frame 40 from the front side in a state in which the longitudinal direction of the hammer 30 is almost parallel to the frontward-and-rearward direction. The engagement depression 31 of the hammer 30 is open at the rear thereof. Consequently, when the hammer 30 is moved rearward in parallel, the engagement depression 31 naturally engages with the hammer rotation shaft 43.

According to this embodiment, three or more integrated continuous parts are formed at positions deviated with respect to one another in both the upward-and-downward direction and the frontward-and-rearward direction, and, at the same time, are not arranged in a straight line. Consequently, it is possible to secure high bending stiffness of the frame 40 in all directions perpendicular to the first side-by-side arrangement direction of keys, including the second upward-and-downward direction and the third frontward-and-rearward direction, even in a frame structure in which the plate-shaped part is small, and, at the same time, it is also possible to reduce the amount of resin used.

Also, since the front side support part 41 is the main body contact part that jointly has a function to support the corresponding hammer 30 by the provision of the hammer rotation shaft 43 and a function to fix itself to the deck in a direct contact manner, it is possible to increase the efficiency in the arrangement as the "integrated continuous parts" and to contribute to reduction in the amount of resin used.

Also, the key guide connection part 49 is formed at a position different from the plate-shaped part 54 to which the end stopper 55 is mounted and the front side support part 41 which is in contact with the deck 19 when viewed from the side of the frame 40. Since the key guide part 50 formed at the key guide connection part 49 guides the pivoting movement of the corresponding key, a large load is not applied to the key guide connection part 49 and the key guide part 50, unlike the plate-shaped part 54 and the front side support part 41. For this reason, the strength required for the key guide connection part 49 is lowered. On the other hand, since the key guide connection part 49 and the front side support part 41 are connected to each other by the corresponding vertical rib 46, it is possible to secure the stiffness of the frame and, at the same time, to reduce the amount of resin used.

Also, since the key guide parts 50 for each white key and each black key are provided at the common guide connection part 49, it is possible to increase the efficiency in arrangement of the key guide parts 50 for each white key and each black key and, at the same time, to secure the strength or rigidity in connection between all of the key guide parts 50 although a small amount of resin is used.

Meanwhile, it is not inevitably necessary to form the entirety of the frame 40 of resin in one united body. The fundamental portions, such as the integrated continuous parts and the vertical ribs 46, of the frame 40 may be formed of resin in one united body. Consequently, the frame 40 may include a separate body, or part of the frame 40 may be formed of another material. Also, when the ease of forming the frame 40 out of resin is not considered, it is not inevitably necessary to form the respective "frame function parts" at the frame 40 in one united body.

Meanwhile, the vertical rib 46 may extend in the direction intersecting the side-by-side arrangement direction of keys to connect the integrated continuous parts to one another. Also, the vertical rib 46 may be formed in the shape of a plate.

Meanwhile, in this embodiment, the key-pressing start position and the key-pressing end position of the keys 10 and 20 are configured such that the key-pressing start position and the key-pressing end position of the keys 10 and 20 are restricted by contact between the initial stopper 48 and the corresponding hammer 30 and between the end stopper 55 and the corresponding hammer 30. However, the part configured to contact these stoppers may not be limited to the hammer 30. For example, rotary members operatively connected to the keys 10 and 20 such that the rotary members can rotate may contact the stoppers.

Meanwhile, the male and female relationship between the engagement depression 31 of the hammer 30 and the hammer rotation shaft 43 of the frame 40 may be reversed.

Second Embodiment

Although the keyboard device in which the hammers 30 are provided is shown in the first embodiment, the hammers 30 are omitted in a second embodiment.

Figure 4:
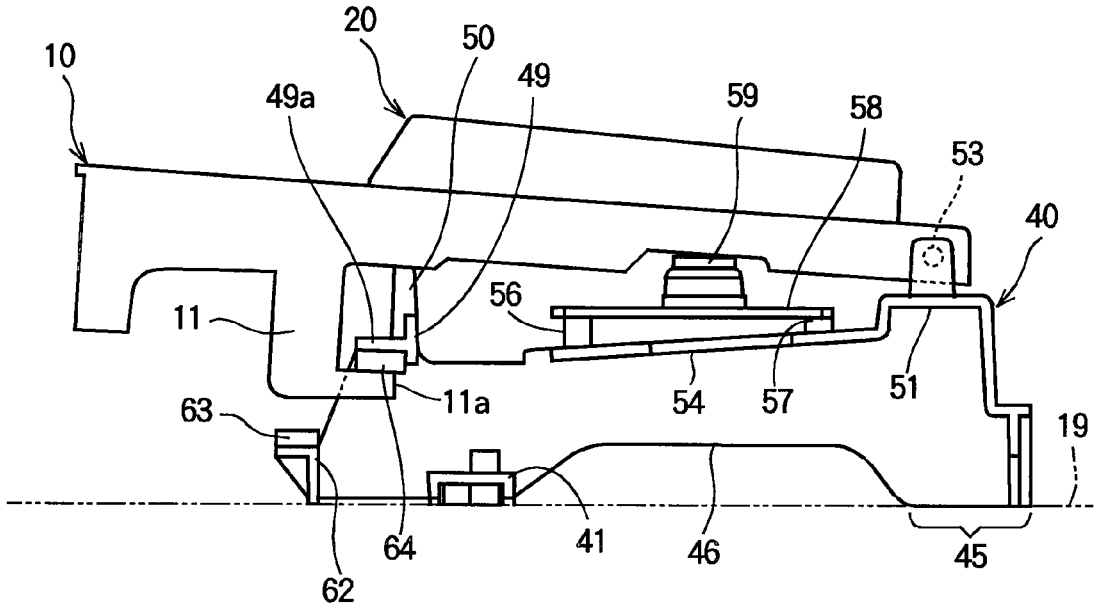
FIGS. 4(*a*) and 4(*b*) are side views illustrating the interior structures of a first example (FIG. 4(*a*)) and a second example (FIG. 4(*b*)) of a keyboard device according to a second embodiment of the present invention.
Figure 4:
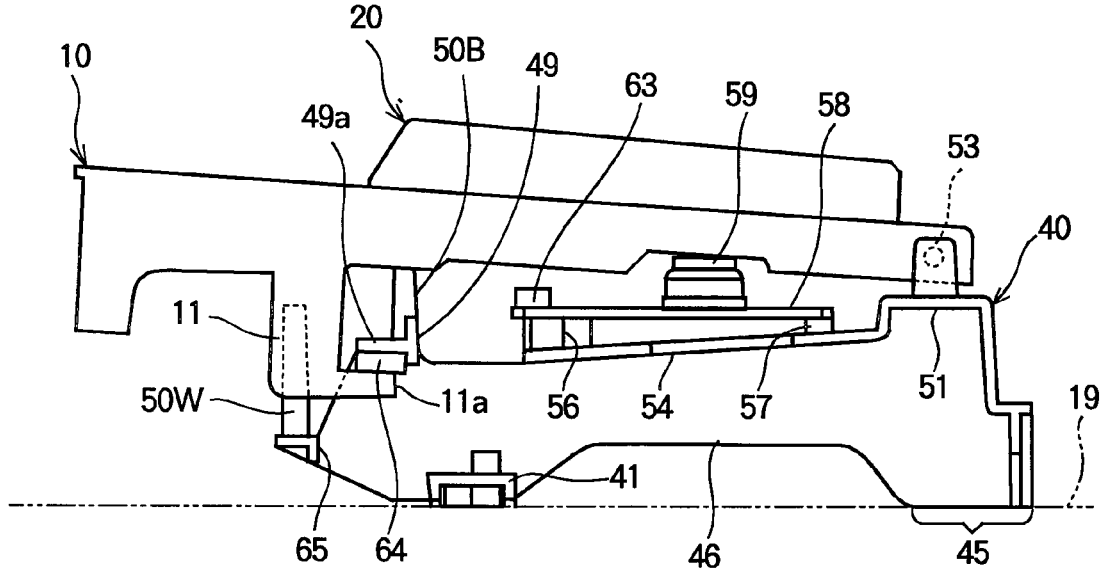

FIG. 4(*a*) is a side view illustrating the interior structure of a first example of a keyboard device according to a second embodiment of the present invention. As shown in FIG. 4(*a*), an extension part 11*a* is formed at the lower part of a lower perpendicular piece 11 of each of the keys 10 and 20 in one united body such that the extension part 11*a* extends rearward. A stopper mount part 62 is formed at the front part of a frame 40 in one united body below the lower perpendicular piece 11. In place of the end stopper 55 (See FIG. 1), an end stopper 63, which is a member equivalent to the end stopper 55, is mounted to the top of the stopper mount part 62. The same structure is applied to each of the black keys 20.

Also, a stopper mount part 49*a* is formed at the lower part of a key guide connection part 49 in one united body such that the stopper mount part 49*a* extends frontward from the lower part of the key guide connection part 49. In place of the initial stopper 48 (See FIG. 1), an initial stopper 64, which is a member equivalent to the initial stopper 48, is mounted to the bottom of the stopper mount part 49*a*. The same structure is applied to each of the black keys 20.

That is, the end stopper 55 and the initial stopper 48 (See FIG. 1) are omitted, and the end stopper 63 and the initial stopper 64 are provided as substitutes. Correspondingly, the shape of the frame 40 is different from that in the first embodiment. Also, although not shown, urging members, such as springs, which continuously urge the keys 10 and 20 in the direction in which the keys are separated from the frame 40 are interposed between the keys 10 and 20 and the frame 40. The remaining structure of this embodiment is identical to that of the first embodiment.

In a state in which no key is pressed, the extension part 11*a* of the lower perpendicular piece 11 of each of the keys 10 and 20 is in contact with the bottom of the initial stopper 64, whereby the key-pressing start position of each of the keys 10 and 20 is restricted. Also, when one of the keys 10 and 20 is pressed, the lower part of the lower perpendicular piece 11 of the corresponding one of the keys 10 and 20 comes into contact with the top of the end stopper 63, with the result that the key-pressing end position of the corresponding one of the keys 10 and 20 is restricted during the going stroke of the pressed key.

In this embodiment, the end stopper 63 and the initial stopper 64 correspond to the above-mentioned "frame function parts" in addition to the front side support part 41, the rear side support part 45, the key guide part 50, the key support part 53, and the key switch 59. Also, the stopper mount part 49*a* and the stopper mount part 62 correspond to the "integrated continuous parts" in addition to the front side support part 41, the rear side support part 45, the key guide connection part 49, the key support part connection part 51, and the plate-shaped part 54.

FIG. 4(*b*) is a side view illustrating the interior structure of a second example of the keyboard device according to the second embodiment of the present invention. The second example is different from the first example in that the position where the end stopper 63 is disposed is changed, and the key guide part 50 includes a key guide part 50W for each white key 10 and a key guide part 50B for each black key 20 which is disposed at the rear of the key guide part 50W. The remaining structure of this example is identical to that of the first example.

As shown in FIG. 4(*b*), a key guide connection part 65 is formed at the front part of a frame 40 in one united body below a lower perpendicular piece 11. A key guide part 50B protrudes from a key guide connection part 49. A key guide part 50W protrudes from the key guide connection part 65. Also, an end stopper 63 is provided at the top of a board 58.

In a state in which no key is pressed, an extension part 11*a* of a lower perpendicular piece 11 of each of the keys 10 and 20 is in contact with the bottom of an initial stopper 64, whereby the key-pressing start position of the corresponding one of the keys 10 and 20 is restricted, in the same manner as the first example. Also, when one of the keys 10 and 20 is pressed, the bottom of a key main body of the corresponding one of the keys 10 and 20 comes into contact with an end stopper 63, with the result that the key-pressing end position of the corresponding one of the keys 10 and 20 is restricted during the going stroke of the pressed key.

The pivoting operations of the keys 10 and 20 are performed as follows. For the black key 20, the pivoting movement of the black key 20 is guided by the engagement with the key guide part 50B, in the same manner as the first example. For the white key 10, the pivoting movement of the white key 10 is guided by the engagement between the lower perpendicular piece 11 and the key guide part 50W, in the same manner as the first example. Since the key guide part 50W for the white key 10 is located in front of the key guide part 50B for the black key 20, the key guide part 50W exhibits high ability to guide the pivoting movement of the white key 10. In the second example, the key guide connection part 65 corresponds to one of the "integrated continuous parts" in place of the stopper mount part 62, which corresponds to one of the "integrated continuous parts" of the first example.

According to this embodiment (first and second examples), it is possible to secure high bending stiffness of the frame 40 in all directions perpendicular to the side-by-side arrangement direction of keys, and, at the same time, it is possible to reduce the amount of resin used, thereby providing the same effect as the first embodiment.

Also, it is possible to increase a degree of freedom in arrangement of the key guide connection part 49, the stopper mount part 62 (See FIG. 4(*a*)), and the key guide connection part 65 (See FIG. 4(*b*)), thereby providing the same effect as the first embodiment.

Also, since the key guide connection part 65 is formed at a position different from the positions where the plate-shaped part 54 and the front side support part 41 are formed when viewed from the side of the frame 40, it is possible to lower the strength required for the key guide connection part 49 and, at the same time, the key guide connection part 65.

Third Embodiment

A third embodiment of the present invention is different from the first embodiment in that the structure of the key guide part 50 is different from the first embodiment, and, correspondingly, the shape of the keys 10 and 20 is different from the first embodiment. The remaining structure of this embodiment is identical to that of the first embodiment.

Figure 5A:
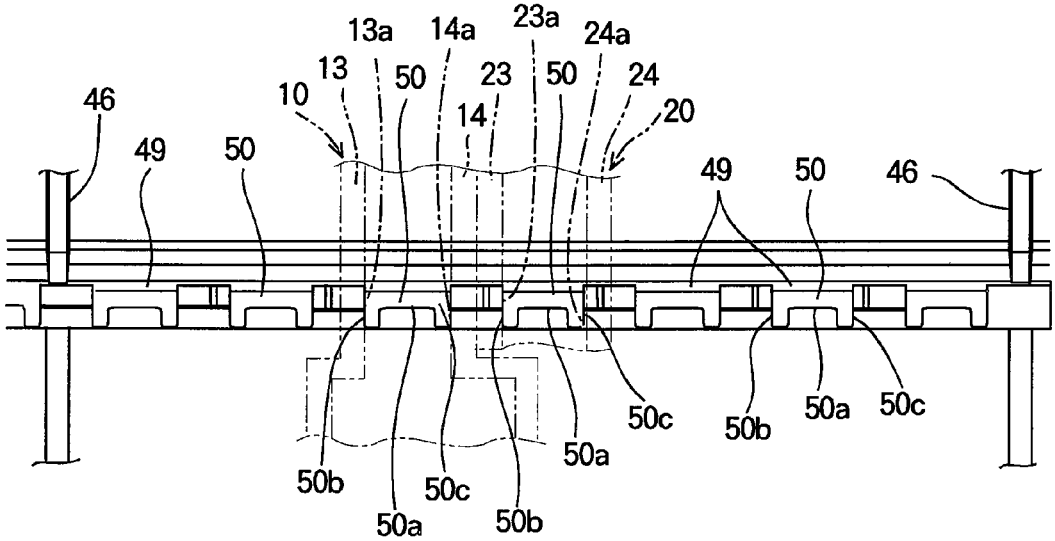
FIGS. 5(*a*) and 5(*b*) are a partial plan view (FIG. 5(*a*)) and a perspective view (FIG. 5(*b*)) illustrating key guide connection parts and key guide parts of a first example of a keyboard device according to a third embodiment of the present invention.
Figure 5B:
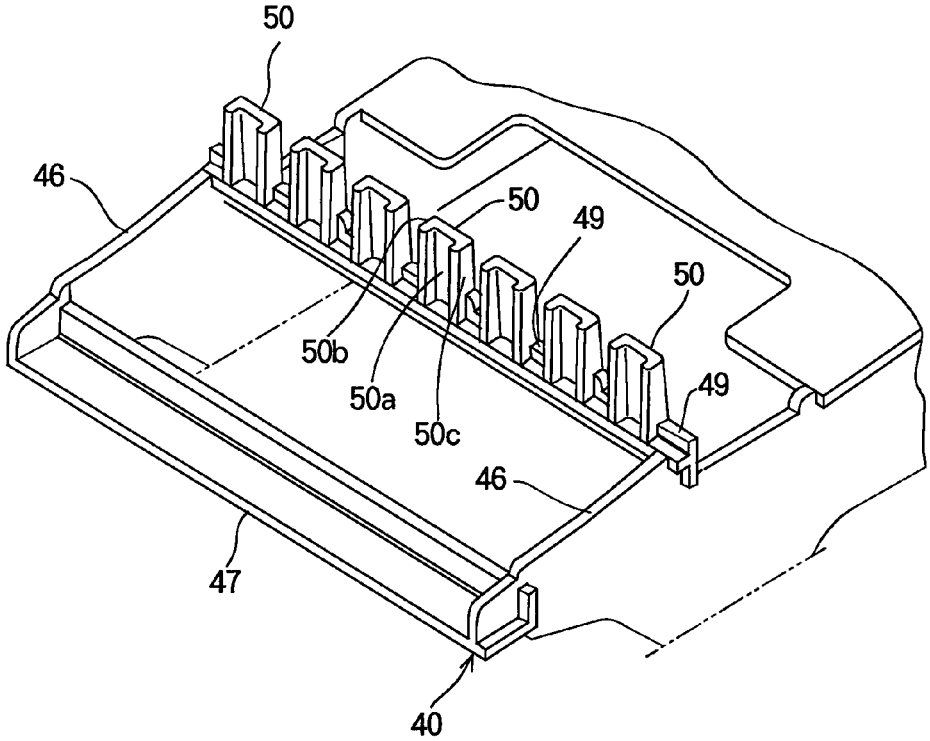

FIGS. 5(*a*) and 5(*b*) are a partial plan view and a perspective view illustrating key guide connection parts 49 and key guide parts 50 of a first example of a keyboard device according to a third embodiment of the present invention.

As shown in FIGS. 5(*a*) and 5(*b*), each of the key guide parts 50 is formed in a horizontal sectional shape of "]" having a depression 50*a* open frontward. On the other hand, each of the keys 10 has left and right side walls 13 and 14 extending perpendicularly downward therefrom, and each of the keys 20 has left and right side walls 23 and 24 extending perpendicularly downward therefrom (See FIG. 5(*a*)).

When one of the keys 10 and 20 is pivoted vertically, inside surfaces 13*a* and 14*a* of the left and right side walls 13 and 14 or inside surfaces 23*a* and 24*a* of the left and right side walls 23 and 24 of the corresponding one of the keys 10 and 20 slide with respect to left and right outside surfaces 50*b* and 50*c* of the corresponding key guide part 50 perpendicular to the side-by-side arrangement direction of keys. As a result, the pivoting movement of the corresponding one of the keys 10 and 20 is guided. Since each key guide part 50 is formed in the shape of "]", it is possible to secure the stiffness of the key guide part 50 and, at the same time, to reduce the thickness of the key guide part 50 in the frontward-and-rearward direction. Also, it is possible to reduce the amount of resin used. Meanwhile, the depression 50*a* of each key guide part 50 may be open rearward.

FIGS. 6(*a*), 6(*b*) and 6(*c*) are a partial plan view, a front view, and a right side view illustrating key guide connection parts 49 and key guide parts 50 of a second example of the keyboard device according to the third embodiment of the present invention.

As shown in FIGS. 6(*a*) to 6(*c*), each of the key guide parts 50 includes a key guide part 50W for each white key 10 and a key guide part 50B for each black key 20, which are different in shape from each other but are fundamentally identical in structure to each other. Each of the key guide parts 50W and 50B has a pair of ribs 61 extending frontward in the direction perpendicular to the side-by-side arrangement direction of keys. Each of the key guide parts 50W and 50B is formed in the horizontal sectional shape of "]" open frontward. In comparison between the key guide parts 50W and 50B, the ribs 61 of the key guide part 50W are located more frontward than the ribs 61 of the key guide part 50B, and the ribs 61 of the key guide part 50W are longer than the ribs 61 of the key guide part 50B.

On the other hand, an engagement rib 15 protrudes from each key 10 such that the engagement rib 15 extends perpendicularly downward therefrom at the middle of the side-by-side arrangement direction of keys, and an engagement rib 25 protrudes from each key 20 such that the engagement rib 25 extends perpendicularly downward therefrom at the middle of the side-by-side arrangement direction of keys (See FIG. 6(*a*)). For the purpose of retaining the strength of each of the engagement ribs 15 and 25, each of the engagement ribs 15 and 25 is formed at a rib extending in the side-by-side arrangement direction of keys in one united body, with the result that each of the resulting ribs is formed in the shape of "T". The engagement rib 15 of each of the keys 10 is fitted between a pair of ribs 61 of the corresponding key guide part 50W, and the engagement rib 25 of each of the keys 20 is fitted between a pair of ribs 61 of the corresponding key guide part 50B.

When one of the keys 10 and one of the keys 20 are pivoted vertically, the engagement ribs 15 and 25 of the corresponding ones of the keys 10 and 20 slide with respect to opposite inside surfaces 61*a* of a pair of ribs 61 of each of the corresponding key guide parts 50W and 50B. As a result, the pivoting movement of the corresponding ones of the keys 10 and 20 is guided. Since the position where the engagement rib 15 slides with respect to the key guide part 50 is located more frontward than the position where the engagement rib 25 slides with respect to the key guide part 50, the positions of the engagement rib 15 and the engagement rib 25 are optimized. In particular, it is possible to increase stability in guiding the pivoting movement of each of the white keys 10. Furthermore, since the key guide parts 50W and 50B are provided at the common key guide connection part 49, it is possible to increase the efficiency in arranging the respective guide parts 50 of the white keys and the black keys and, at the same time, to secure the strength in connection between all of the key guide parts 50 although a small amount of resin is used.

Also, the side walls of the keys 10 and 20 are inclined to collapse during molding, and it is difficult to maintain precision. However, the engagement ribs 15 and 15 are difficult to collapse. In the second example, therefore, the precision is not affected due to the collapse of the side walls of the keys 10 and 20 as compared with the first example. Consequently, it is possible to stably guide the pivoting movements of the keys 10 and 20.

Meanwhile, any other structure may be adopted in place of a pair of ribs 61 of each of the key guide parts 50W and 50B as long as the adopted structure engages with the engagement ribs 15 and 25 of the keys 10 and 20 in a slide contact manner.

According to this embodiment (first and second examples), it is possible to provide the same effect as the second embodiment.

As described above and as exemplified by the diverse embodiments, the keyboard device according to the present invention basically comprises a plurality of keys (10, 20) arranged in parallel, a frame (40) formed of resin in one united body, the frame being supported at an instrument main body (19) to support the respective keys such that the respective keys are pivoted by key-pressing and key-releasing operations, a frame function part (41, 43, 45, 48, 50, 53, 55, 59, 63, 64) provided at the frame in one united body or as a separate body, the frame function part being configured to engage, in contact, with a component of the keyboard device excluding the frame during the use of the keyboard device, at least two integrated continuous parts (41, 45, 47, 49, 49*a*, 51, 54, 62, 65) including a part formed at the frame in one united body, extending continuously in one united body over a key zone having a plurality of keys in a side-by-side arrangement direction of keys, and receiving external force directly or via the frame function part and/or a part formed at the frame in one united body, extending continuously in one united body over a key zone having a plurality of keys in the side-by-side arrangement direction of keys, and allowing a component constructed separately from the frame to be mounted thereto, and a connection rib (46) formed at the frame in one united body such that the connection rib extends in a direction intersecting the side-by-side arrangement direction of keys, the connection ribs being provided for each key zone having a plurality of keys, the at least two integrated continuous parts being formed at positions deviated with respect to each other in both an upward-and-downward direction and a frontward-and-rearward direction, when viewing a side of the frame, and connected to each other only by the connection rib.

Preferably, the connection rib is formed in the shape of a plate extending in a direction perpendicular to the side-by-side arrangement direction of keys.

Preferably, the integrated continuous parts include at least three integrated continuous parts, and the at least three integrated continuous parts are not arranged in a straight line when viewed from the side of the frame.

Preferably, a key guide part (50) provided for each of the keys to guide a pivoting movement of the corresponding key and an initial stopper part (48, 64) contacting each of the keys or a rotary member (30) operatively connected to each of the keys such that the initial stopper part restricts a key-pressing start position of each of the keys during a going stroke of the pressed key are provided as the frame function part, and the integrated continuous parts include a key guide arrangement part (49) where the key guide part is provided and an initial stopper arrangement part (47, 49*a*) where the initial stopper part is provided, the key guide arrangement part and the initial stopper arrangement part being separated from each other above a part (41, 45) of the frame contacting the instrument main body and connected to each other only by the connection rib.

Preferably, a plurality of hammer support parts (43) formed at the frame in one united body and arranged along the side-by-side arrangement direction of keys are provided as the frame function part, the keyboard device further includes a plurality of hammers (30) arranged in parallel such that the hammers correspond to the respective keys, the hammers being supported at the respective hammer support parts such that the hammers are operatively connected to the corresponding keys below the corresponding keys to rotate about the respective hammer support parts, the hammers providing inertia with respect to the pivoting movements of the corresponding keys, and the integrated continuous parts include hammer shaft arrangement parts (41) where the hammer support parts are provided.

Preferably, a key guide part (50) provided for each of the keys to guide a pivoting movement of the corresponding key is provided as the frame function part, and the integrated continuous parts include a key guide arrangement part (49) where the key guide part is provided.

Preferably, each of the hammers is configured such that a rear part (30*r*) of each of the hammers is rotated upward during the going stroke of the corresponding pressed key, a hammer stopper (48) contacting a front part (30*f*) of each of the hammers during the going stroke of the pressed key to restrict a rotation start position of each of the hammers is provided as the frame function part, and the integrated continuous parts include a hammer stopper arrangement part (47) where the hammer stopper is provided.

Preferably, a main body contact part (41) contacting the instrument main body to support the frame at the instrument main body is provided as the frame function part, and the main body contact part is configured to belong to the integrated continuous parts and also to function as the hammer support parts.

What is claimed is:

1. A keyboard device comprising:

a plurality of keys arranged in parallel to each other;

a frame formed of resin in one united body, the frame being supported at an instrument main body and supporting the respective keys such that the respective keys are pivoted by key-pressing operation and key-releasing operation;

a frame function part provided at the frame in one united body with the frame or as a separate body from the frame, the frame function part being configured to engage, in contact, with a component of the keyboard device excluding the frame during the use of the keyboard device;

at least two integrated continuous parts comprising a part formed at the frame in one united body with the frame, the integrated continuous part extending continuously over a key zone including a plurality of keys in a first direction along which the keys are arranged side-by-side, the integrated continuous part receiving external force directly or via the frame function part and/or allowing a component constructed separately from the frame to mount on the integrated continuous part; and a connection rib formed at the frame in one united body with the frame such that the connection rib extends in a direction intersecting the first direction along which the keys are arranged side-by-side, each connection rib being provided per a plurality of keys, wherein the at least two integrated continuous parts are formed at positions deviated with respect to each other, when viewed from a side of the frame, in both a second direction along which the keys are pivoted by key-pressing operation and key-releasing operation and a third direction along which each key extends from front to rear of the keyboard device, the at least two integrated continuous parts being connected to each other only by the connection rib.

2. The keyboard device according to claim 1, wherein the connection rib is formed in the shape of a plate extending in a direction perpendicular to the first direction along which the keys are arranged side-by-side.

3. The keyboard device according to claim 1, wherein the integrated continuous parts comprise at least three integrated continuous parts, and the at least three integrated continuous parts are not aligned in a straight line when viewed from the side of the frame.

4. The keyboard device according to claim 1, comprising:

a key guide part provided for each of the keys to guide pivoting movement of the corresponding key; and an initial stopper part contacting each of the keys or a rotary member linked to each of the keys to rotate with each key, such that the initial stopper restricts an initial position of each key at the key-pressing operation in a going stroke of the key, wherein the frame function part comprises the key guide part and the initial stopper part, and the integrated continuous parts comprise a key guide arrangement part where the key guide part is provided and an initial stopper arrangement part where the initial stopper part is provided, the key guide arrangement part and the initial stopper arrangement part being separated from each other above a part of the frame contacting the instrument main body and being connected to the part of the frame only by the connection rib.

5. The keyboard device according to claim 1, further comprising a plurality of hammers arranged in parallel to each other such that the hammers correspond to the respective keys, the hammers providing inertia with respect to the pivoting movements of the corresponding keys, wherein the frame function part comprises a plurality of hammer support parts formed at the frame in one united body and arranged in the first direction along which the keys are arranged side-by-side, the hammer support parts supporting the respective hammers such that the hammers are operatively connected to the corresponding keys below the corresponding keys to rotate about the respective hammer support parts, and the integrated continuous parts include a hammer shaft arrangement part where the hammer support parts are provided.

6. The keyboard device according to claim 5, wherein the frame function part comprises a key guide part provided for each of the keys to guide the pivoting movement of the corresponding key, and the integrated continuous include a key guide arrangement part where the key guide parts are provided.

7. The keyboard device according to claim 5, wherein each of the hammers is configured such that a rear part of each of the hammers is rotated upward during a going stroke of the corresponding key, the frame function part comprises a hammer stopper contacting a front portion of each of the hammers during the going stroke of the key to restrict a rotation start position of each of the hammers, and the integrated continuous parts include a hammer stopper arrangement part where the hammer stoppers are provided.

8. The keyboard device according to claim 5, wherein the frame function part comprises a main body contact part contacting the instrument main body to support the frame at the instrument main body, the main body contact part being configured to belong to the integrated continuous parts and also to function as the hammer support parts.

* * * * *